United States Patent [19]

Holtzberg

[11] Patent Number: 4,848,292

[45] Date of Patent: Jul. 18, 1989

[54] INTERNAL COMBUSTION ENGINE BLOCK AND CYLINDER HEAD

[76] Inventor: Matthew Holtzberg, 55 Copper Hill Park, Ringwood, N.J. 07456

[21] Appl. No.: 186,617

[22] Filed: Apr. 27, 1988

[51] Int. Cl.[4] ..... F02F 1/10

[52] U.S. Cl. ..... 123/193 CH; 123/195 C

[58] Field of Search ..... 123/193 CH, 193 C, 195 R, 123/195 C

[56] References Cited

U.S. PATENT DOCUMENTS 4,644,911 2/1987 Hidaka et al. ..... 123/195 C 4,726,334 2/1988 Holtzberg et al. ..... 123/195 C

*Primary Examiner*—E. Rollins Cross

*Attorney, Agent, or Firm*—Klauber & Jackson

[57] ABSTRACT

A cylinder head and engine block assembly for internal combustion engine includes a cylinder head formed from a fiber-reinforced phenolic resin, and an engine block formed from a fiber-reinforced phenolic resin, and an arrangement for placing the head and block assembly under a loading compression pressure; preferably the fiber reinforcement is made up of fibers of fiberglass or graphite having a length of about ⅛" to 1"; the cylinder head body has embedded in or united with it a unitary metal insert defining the upper portion of at least one inlet port and at least one exhaust port and combustion chamber, the block has embedded in or united with it a unitary metal unit defining at least one cylinder liner, and the block has upper bearing supports embedded in or united with the block.

12 Claims, 1 Drawing Sheet

INTERNAL COMBUSTION ENGINE BLOCK AND CYLINDER HEAD

FIELD OF THE INVENTION

This invention relates to internal combustion engines and is more particularly concerned with an engine block and cylinder head construction for such engines, and more particularly to one utilizing a plastic composite as a construction medium.

BACKGROUND OF THE INVENTION

In the past, internal combustion engines have conventionally been made of metal, usually cast iron. Cast iron engines are effective, but they are generally noisy, heavy and are becoming increasingly expensive and time consuming to produce. Generally, the weight and bulk of an engine substantially affects the overall performance, e.g., fuel efficiency of the car, truck, boat, airplane or other vehicle or machine which it powers. Corrosion is a major problem in marine and industrial engines as well. Moreover high fixed asset costs to build new engine facilities are at this time a considerable problem. Costs to operate and maintain foundries have sky-rocketed. Sand and permanent mold casting technology has not kept up with the reduced manufacturing times which engine manufacturers believe are necessary to remain competitive in the world-wide marketplace.

In the search for ways to improve production economics and to reduce engine noise and weight and to increase fuel efficiency it has been proposed to construct engines and engine parts from materials of a lighter weight than the heavy metal, e.g., cast iron, conventionally used in the automotive art. In my prior U.S. Pat. Nos. 4,430,906; 4,430,969; 4,430,970; 4,432,311; 4,432,925; 4,433,652; 4,433,964; 4,440,069; 4,453,505; 4,458,555, for example, it has been proposed to manufacture various engine parts, such as wrist pins, rocker arms, tappets, piston rings, valve spring retainers, push rods, timing gears, valves, connecting rods and the like, from certain amide-imide polymeric materials which have been found to be particularly suitable for such purposes. Linsenmann, U.S. Pat. No. 4,186,696 discloses a push rod formed from resin reinforced with fibers, such as glass fibers. Driver, U.S. Pat. No. 4,306,489 describes a composite piston formed from a fiber-reinforced epoxy resin and having an aluminum cap portion. The engine head and block, however, have presented more of a problem, although some steps in this direction have been taken. The patent art, for example, includes Hartsock, U.S. Pat. No. 4,508,066 which shows a head assembly comprising a cast ceramic body. Rynbrandt, U.S. Pat. No. 4,398,527 discloses the coating of the manifold and combustion surfaces of a conventional internal combustion engine with a resinous composition comprising a polyimide or polyamide resin. Formia, U.S. Pat. No. 4,436,066 describes a cylinder head formed from aluminum, and an aluminum cylinder head construction is also disclosed in Hayashi et al, U.S. Pat. No. 4,614,172. Tsuchiya et al, U.S. Pat. No. 4,515,112 discloses an aluminum alloy cylinder block and Kubozuka, U.S. Pat. No. 4,446,827 discloses a cylinder block having a metallic body and side cover members formed from rubber or plastic which are present primarily for the purpose of suppressing noise and vibrations. Unfortunately, these non-cast iron engines or modified conventional engines have, in general, become as expensive and laborious to produce as the traditional engine and they tend to possess less than desired mechanical properties at operating temperatures.

It has been proposed by me to build plastic composite engine blocks and cylinder heads, such as described in "Popular Mechanics", September, 1982, p. 71, but these prior proposals have involved only very expensive materials and techniques entirely unsuited to mass production and cost effectiveness.

There has, therefore, been a continuing need and search for relatively lightweight cylinder heads and engine blocks for internal combustion engines which are effective and long-lasting in use, yet which can be mass produced economically and which attenuate noise.

It is, accordingly, an object of the present invention to provide an improved lightweight engine block and cylinder head construction for internal combustion engines.

It is a further object of the invention to provide an engine block and cylinder head construction of the character indicated which is formed from relatively-inexpensive resinous material.

It is a still further object of the invention to provide an effective engine block and cylinder head construction for internal combustion engines which is lightweight, is formed from relatively inexpensive resinous materials, and can be efficiently mass produced in a cost-effective manner.

SUMMARY OF THE INVENTION

In accordance with the invention, an internal combustion engine block and cylinder head are formed from phenolic resin fiber reinforced for example with fiberglass or graphite fibers, preferably the former, the fibers generally having a length of milled or flaked dimensions to 1". The head and block cooperate in the usual manner, the head having a combustion chamber, intake and exhaust ports and the block defining one or more cylinders, and the block and head construction being adapted to receive pistons and the other parts of a conventional internal combustion engine. Characteristic of the block and head construction of the invention is that the block and head are suitably united under constant compression by means of nuts threaded on the ends of stud bolts which extend through the head and the block and are tightened to maintain a loading compression pressure of 6 to 15,000 psi.

Other objects and features of the invention will be readily apparent from the following detailed description of the invention and from the accompanying drawings wherein,

DETAILED DESCRIPTION OF THE PREFERRED EMBODIMENTS

Figure 1:
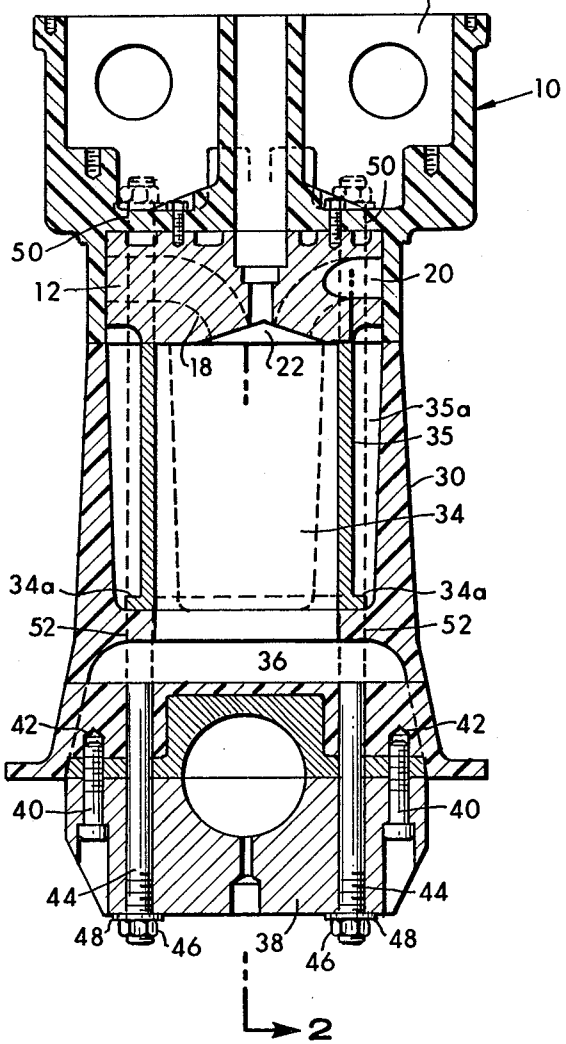
FIG. 1 is a transverse cross-sectional view, through the vertical axis of an engine block and cylinder head construction embodying features of the present invention, taken approximately along the line 1—1 of FIG. 2.

Referring to the drawings, and particularly to FIG. 1, the reference numeral 10 designates the engine cylinder head constructed in accordance with the invention. Illustrated by way of example only is a multi-cylinder engine, of which only two cylinders are shown. The head 10 is formed from fiber reinforced resinous plastic material, in accordance with the invention, as will be hereinafter described, but has an integral aluminum combined combustion chamber and port unit 12 which is in the form of a single casting embedded in or united with the resinous body of the head 10. By "embedded" is meant that the casting is inserted during either the injection or compression molding process. By "united" is meant that the casting, following any appropriate machining, is secured to the resinous body by mechanical means, such as fastening. The unit 12 extends substantially the length of the head and defines, for each cylinder of the associated block, an inlet port 18 and an exhaust port 20, and the combustion chamber 22 of each cylinder. In its upper portion, the head 10 has a recess 24 for receiving cam shafts, valve stems, valve springs, and the like (not shown) as are found in conventional internal-combustion engines. Coolant chambers 26 and 27 overlie the upper portion of the unit 12. The metal unit 12 readily conducts engine heat to the coolant.

Below the head 10 is the block 30, which contains the cylinders 34. In accordance with the invention, the cylinders are defined by a liner or insert 35, which is suitably formed from iron or aluminum. The cylinder inset or unit 35, like the head unit 12, is formed das a single unitary piece extending longitudinally of the block and is composed of a base portion 34*a* and cylindrical extensions which form the vertical walls of each cylinder 34. The base portion 34*a* is shaped so that it has a peripheral flange at the lower ends of the cylindrical portions. The flange is either embedded in or united with the surrounding resin. The cylinder unit 35 is like the head unit 12, integral and is a single casting embedded in or united with the surrounding resinous or plastic body, in this case the plastic body forming the block. The unit 12 and the unit 35 effectively reinforce the plastic head and block bodies and the combined assembly of head and block. A water jacket or engine coolant chamber 35*a* is defined in the body of block 30 around cylinder unit 35 which, because it is of metal, readily conducts heat from the cylinder to the engine coolant.

Figure 2:
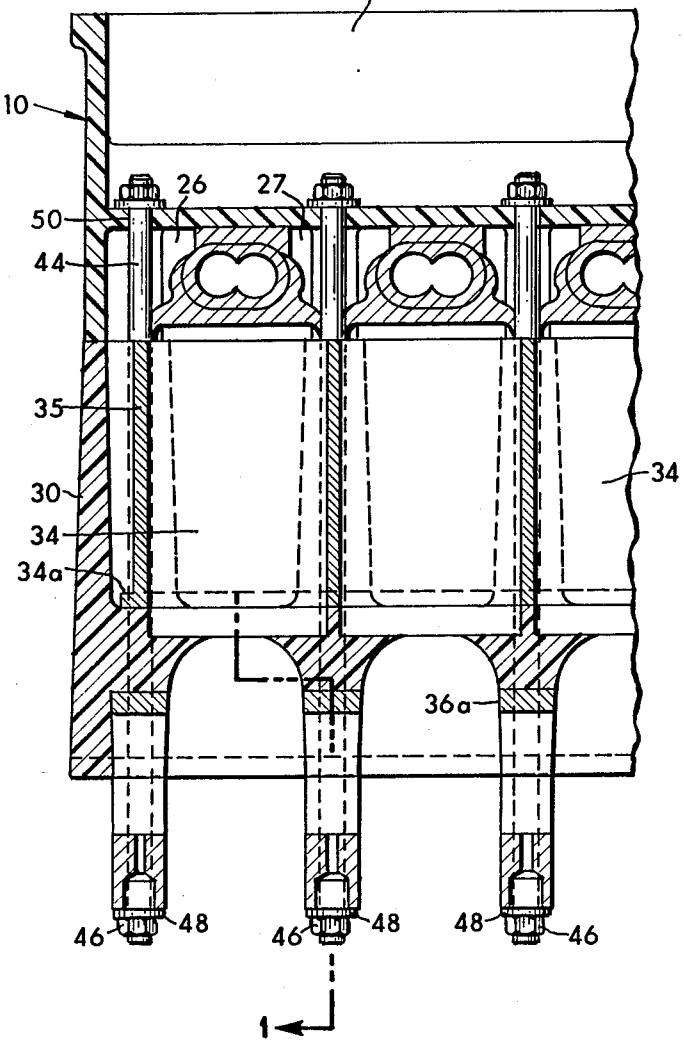
FIG. 2 is a partial vertical sectional view, through the longitudinal axis of the engine block and cylinder head construction shown in FIG. 1, taken approximately along the line 2—2 of FIG. 1.

As seen in FIGS. 1 and 2, the lower surfaces of block 30 or block webs, which engage bearings (not shown) for the crankshaft, are faced with aluminum bearing inserts 36 which define bearing upper supports 36*a* and which are integrally embedded in or united with the resinous body of block 30. These inserts 36 not only make contact with the bearing through the upper bearing support 36*a* but also reinforce the plastic body of the block.

The main bearing caps 38 for the crankshaft are metal, generally iron or aluminum, and are secured to the block body by means of bolts 40 which extend through the aluminum bearing inserts 36 into tapped recesses 42 in the body of block 30. It is one aspect of the invention, however, that the recesses 42 can be threaded metal inserts integrally molded into the plastic body of the block, so that the need for tapping is eliminated.

The entire assembly of head, block and bearing caps is united in compressive relationship by means of stud bolts 44, suitably of steel, which cooperate with nuts 46 which conveniently overlie washers 48. The stud bolts 44 pass through holes 50 in head 10 and through holes 52 in block 30. Bolt holes 50 and 52 can be formed in situ in the plastic body of the block during the molding operation. A conventional gasket, not shown, is used between the head and the block, in the usual manner.

As previously mentioned, characteristic of the head and block body construction of the invention is that they are formed from a fiber-reinforced phenolic resin.

Phenolic resin molding compounds are well-known in commerce, and typical compounds suitable for use in accordance with the invention are supplied, for example, by Rogers Corporation, Molding Materials Division, Manchester, Conn.

Phenolic resins are, of course, products of the condensation reaction of phenol and formaldehyde. Substituted phenols and higher aldehydes may be incorporated to achieve specific resin properties, e.g., flexibility, reactivity, or compatibility with elastomers and other polymers. A variety of phenolic resins can be produced by adjusting the formaldehyde-to-phenol molar ratio and the resinification temperature and catalyst.

Phenolic molding materials are homogeneous mixtures of resin (hexa methylene tetramine to supply formaldehyde, if necessary), reinforcement, filler, lubricant, colorant, and other modifiers. A wide range of engineering properties can be obtained because of resin compatibility with a variety of reinforcements and fillers. Compounded product forms can be granular, nodular, pellets, flake, powder and liquids.

The fiber reinforcement is preferably fiberglass, although other fibers, such as graphite fibers, can also be used. Fiberglass fibers ordinarily have a fiber diameter of 20 to 30$\mu$, whereas graphite fibers generally have a fiber diameter of 5 to 10$\mu$. Combinations of fibers can be employed. The fibers are intimately mixed in the molding compound in conventional manner. Typically both injection molding and compression molding can be employed in producing the head and block of this invention. When injection molding is employed, it is advantageous to use fibers in milled or flaked form or having a length up to about $\frac{1}{8}$" but when compression molding is used, fiber length can be up to about 1", e.g., $\frac{1}{4}$" to 1". In general, therefore, fiber lengths of milled or flaked dimensions up to about $\frac{1}{8}$" to about 1" are most suitably used in the phenolic molding compound. The amount of fiber to phenolic resin, i.e., "loading" is generally 5–75% by volume, preferably 20% to 40% by volume.

The head and block can be either injection or compression molded for closer tolerances, minimals secondary machining operations, and enhanced structural strength. However, they are preferably injection molded for faster processing times, and thereby reduced manufacturing costs. Typical mold temperatures are 250° to 400° F. with material temperature of 220° to 240° F. and pressures of 3,500 to 20,000 p.s.i. Where injection molding is used, the phenolic molding compound is injected into the mold cavity at injection molding temperatures and pressures to fill the cavity and molding chamber. In compression molding, the mold cavity may be manually or otherwise filled as is known in the molding art. The total molding time for either compression or injection molding ranges from 3 to 10 seconds, depending on the grade of the phenolic resin and the thickness of the part being molded. Post cure of 0 to 4 hours may be employed, if desired, depending on the specific resin used and the use temperature for the molded part. After the engine block and head have been molded, they may undergo minimum machining operations. For example, they may be drilled to provide stud bolt holes 50 in head 10 and holes 52 in block 30, and recesses 42 may be suitably tapped. It is possible however to eliminate many of these machining operations by appropriate molding, as discussed above, e.g., by the use of threaded inserts for the recesses 42 and by molding bolt holes 50 and 52.

The lightweight engine block and head assembly of this invention reduces overall engine weight by up to 60%, produces noise attenuation, minimizes rust and corrosion, and makes possible manufacturing time and cost savings by greatly reducing the number of secondary operations which may be applied to give the assembly its finished shape. Composite molding times are significantly shorter than times required for metal casting, as in conventional practice. The head or block can be molded in 3–10 minutes as mentioned. A typical sand cast metal part can take 2–4 hours to process and cast and as long as 2–6 hours to heat treat. The lightweight block and head of this invention can be readily mass produced and are capable of higher horsepower for their weight than conventional metal parts. Conventional metal engines exhibit power to weight ratios (Hp:lbs) of the order of 1:2 to 1:3; whereas engines constructed in accordance with the present invention display power to weight ratios of 1:1 or higher. Such engines further effectively maintain their shape, dimensional stability and structural integrity at operating temperatures.

The composite block and head of this invention have a greater strength to weight ratio than metal, and are heat resistant. The engine block and head of the invention are capable of effectively functioning at engine operating temperature in both hot and cold weather. The assembly has high mechanical strength, particularly at operating temperatures (higher than aluminum), thermal stability, fatigue strength, and excellent compressive strength. The composite assembly has excellent resistance to wear, corrosion, impact, rupture, and creep and reliably operates in the presence of engine fuels, oils and exhaust gases.

It is obvious that various changes and modifications can be made without departing from the invention as defined in the appended claims and it is intended, therefore, that all matter defined in the drawings and in the foregoing description shall be interpreted as illustrative only and not in a limiting sense.

I claim:

1. a cylinder head and engine block assembly for internal combustion engine which comprises, in combination, a cylinder head having a body formed from a fiber-reinforced phenolic resin and an engine block having a body formed from a fiber-reinforced phenolic resin, and means acting on both of said bodies for placing the assembly under a loading compression pressure.

2. A cylinder head and engine block assembly as defined in claim 1, wherein said fiber reinforcement comprises fibers of fiberglass or graphite having a length of milled or flaked dimensions to about 1″.

3. A cylinder head and engine block assembly as defined in claim 1 wherein said means extend through said head body and said block body.

4. A cylinder head and engine block assembly as defined in claim 3, wherein said means comprise stud bolts and nuts on the ends thereof.

5. A cylinder head for an internal combustion engine comprising a body molded from a fiber-reinforced phenolic resin.

6. A cylinder head as defined in claim 5, wherein said fiber reinforcement comprises fibers of fiberglass or graphite having a length of milled or flaked dimensions to about 1″.

7. A cylinder head as defined in claim 5, wherein said body has embedded in or united with it a unitary metal insert defining at least one combustion chamber, at least one inlet port and at least one exhaust port.

8. An engine block for an internal combustion engine comprising a body molded from a fiber-reinforced phenolic resin.

9. An engine block as defined in claim 8, wherein said fiber reinforcement comprises fibers of fiberglass or graphite having a length of milled or flaked dimensions to about 1″.

10. An engine block as defined in claim 8, wherein said block has embedded in or united with it a unitary metal unit defining at least one cylinder liner.

11. An engine block as defined in claim 8, wherein said block has means defining upper bearing support embedded in or united with said body.

12. A cylinder head and engine block assembly for internal combustion engine which comprises, in combination, a cylinder head having a body formed from a fiber-reinforced phenolic resin and an engine block having a body formed from a fiber-reinforced phenolic resin and an engine block having a body formed from a fiber-reinforced phenolic resin and stud bolts extending through said head body and said block body and cooperating nuts placing the assembly under a loading compression pressure, wherein said fiber reinforcement comprises fibers of fiberglass or graphite having a length of milled or flaked dimensions to about 1″; wherein said cylinder head body has embedded in it and integrally united with it a unitary metal insert defining the upper portion of at least one combustion chamber, at least one inlet port, and at least one exhaust port; wherein said block has embedded in or united with it a unitary metal unit defining at least one cylinder; and wherein the said block has means defining upper bearing supports embedded in or united with said body.

* * * * *